United States Patent [19]

Wixon et al.

[11] Patent Number: 4,951,548

[45] Date of Patent: Aug. 28, 1990

[54] APPARATUS AND METHOD FOR SUPPLY OF BELT-LINKED AMMUNITION

[75] Inventors: Philip A. Wixon; William Pitt, both of Wolverhampton, England

[73] Assignee: Lucas Industries, England

[21] Appl. No.: 354,796

[22] Filed: May 22, 1989

[30] Foreign Application Priority Data

May 26, 1988 [GB] United Kingdom ..... 8812464

[51] Int. Cl.[5] ..... F41A 9/79; F41A 9/63

[52] U.S. Cl. ..... 89/33.14; 89/34

[58] Field of Search ..... 89/34, 33.02, 33.1, 89/33.14, 33.16, 33.17, 33.5

[56] References Cited

U.S. PATENT DOCUMENTS

| | | | |
|---|---|---|---|
| 607,681 | 7/1898 | Cochrane . | |
| 2,380,773 | 7/1945 | McMullen . | |
| 2,386,894 | 10/1945 | Hartley . | |
| 2,398,263 | 4/1946 | Trimbach . | |
| 2,557,441 | 6/1951 | Kornblum et al. . | |
| 2,722,865 | 11/1955 | Maillard . | |
| 2,870,681 | 1/1959 | Linke . | |
| 2,889,751 | 6/1959 | Bilek . | |
| 2,951,422 | 9/1960 | Bobkowski . | |
| 3,333,507 | 8/1967 | De Meiss . | |
| 3,456,445 | 7/1969 | Bentele et al. . | |
| 3,911,787 | 10/1975 | Seibel | 89/34 |

FOREIGN PATENT DOCUMENTS

| | | | |
|---|---|---|---|
| 2027773 | 1/1971 | Fed. Rep. of Germany | 89/34 |
| 800249 | 6/1936 | France | 89/33.14 |
| 321217 | 9/1934 | Italy | 89/34 |
| 531695 | 1/1941 | United Kingdom | 89/34 |
| 558521 | 1/1944 | United Kingdom | 89/33.1 |

OTHER PUBLICATIONS

General Electric Company, Vulcan Air Defense System, 1/76, pp 5–89, 4–114, and 4–116–4–118.

*Primary Examiner*—Charles T. Jordan
*Assistant Examiner*—Stephen Johnson
*Attorney, Agent, or Firm*—Andrus, Sceales, Starke & Sawall

[57] ABSTRACT

An apparatus for supplying belt-linked ammunition to a gun. Belt-linked ammunition is supplied to a gun by an apparatus comprising a plurality of standard rectilinear ammunition boxes in which the ammunition belts are arranged so that both of their ends are accessible. The boxes are secured beneath an arcuate supporting guide which traverses with the gun and which has openings through which both ends of each belt can pass, for leading in respective directions towards an adjacent box or towards the gun. The boxes are arranged to extend tangentially of the guide so that the axes of rounds of ammunition within the guide are directed radially of the axis of curvature thereof.

4 Claims, 3 Drawing Sheets

APPARATUS AND METHOD FOR SUPPLY OF BELT-LINKED AMMUNITION

It is known, for example from No. GB-A-579674 to provide a plurality of containers for belt-linked ammunition, the containers moving with the gun as it traverses. It is a disadvantage of the prior art arrangement that the containers are themselves arcuate. It will therefore be necessary to transfer the ammunition from its standard transport containers into a special container for location on the gun mounting. Since ammunition will normally be transported in standard rectilinear containers to a forward operational area in which adverse conditions may be present, transfer of ammunition to a special container may result in fouling of the ammunition or the container, and will require the use of time and manpower which may be in short supply in such a situation. Additionally if such a special container is damaged in service, the gun will be rendered useless if no replacement special container is immediately available.

It is an object of the invention to provide an apparatus and method which overcomes the foregoing disadvantages.

In particular the invention provides an apparatus and method by means of which at least one of the dimensions, in a particular example the longer dimension, of a standard rectangular container is used to enable the belt-linked ammunition to be flexed about an axis normal to the plane of the individual rounds, whereby a plurality of such containers may be grouped on an arc whose radius is not substantially greater than the minimum effective bend radius of the ammunition belt about the aforesaid axis, that is the minimum radius which will allow free movement of the belt towards the gun.

According to the invention an apparatus for supplying belt-linked ammunition to a traversable gun comprises an arcuate support coupled to the gun for traversing movement therewith, means for mounting a plurality of ammunition boxes on said support at intervals therealong, the ammunition belts in said boxes being so disposed as to render both free ends of the belt accessible, and means for guiding said free ends respectively towards the gun and towards an adjacent box, said boxes being substantially in the form of rectangular right prisms, said support including means for rigidly fixing said boxes so that end faces thereof which are parallel to axes of rounds of ammunition therein are also substantially parallel to respective radii extending through the respective boxes from the axis of curvature of said arcuate support, said support also acting as a guide for the ammunition belts.

Preferably said arcuate support has an effective radius which is not less than the minimum effective bend radius of the belt in a plane which includes the axes of individual rounds of ammunition.

According to another aspect of the invention a method for supplying belt-linked ammunition to a traversable gun comprises packing ammunition belts into a plurality of boxes so that both of the free ends of each belt are accessible, mounting said boxes on an arcuate support which traverses with the gun, leading both of the free ends of the belts from each box, coupling one free end of one of the belts to a free end of a belt in an adjacent box, said free ends of the belts being led through guides on said support, and said boxes being substantially rectangular right prisms mounted so that the end walls thereof which are parallel to the axes of rounds of ammunition therin are also substantially parallel to radii from the axis of curvature of said support.

An embodiment of the invention will now be described by way of example only and with reference to the accompanying drawings in which.

Figure 1:
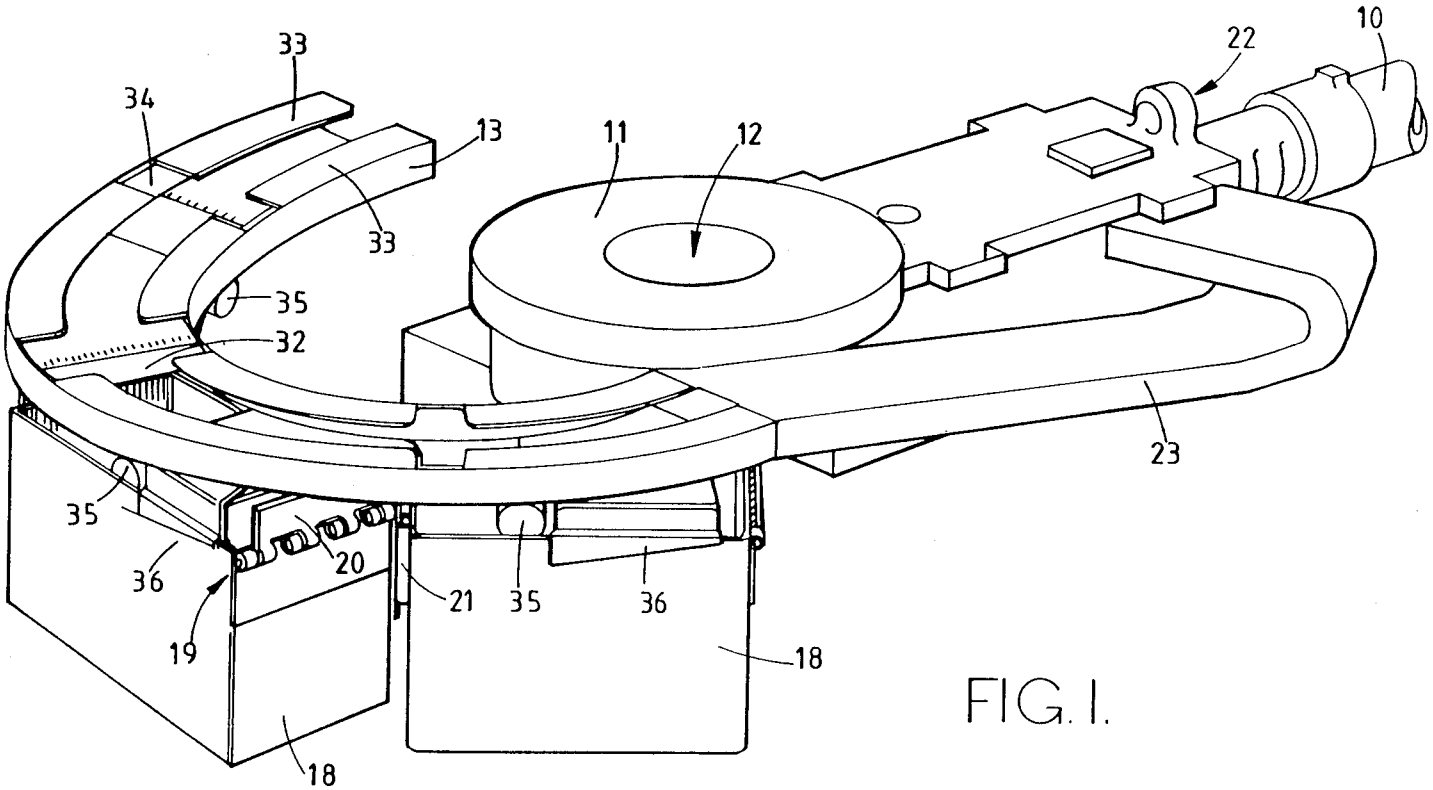
FIG. 1 is a pictorial view of an apparatus for supplying ammunition to a gun.
Figure 4:
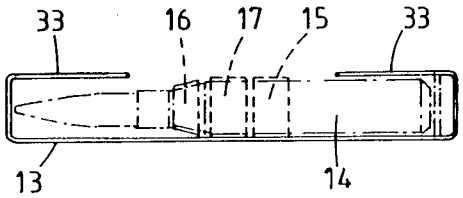
FIG. 4 is a section, to an enlarged scale, on line 4—4 in FIG. 3.

As shown in FIG. 1 a machine gun 10 is mounted on a turret 11 for rotation about an axis 12. Secured to the turret 11 for rotation therewith is an arcuate sheet metal guide 13 for belt-linked ammunition, the cross-section of the guide 13 being shown more clearly in FIG. 4. The ammunition rounds 14 are belt-linked by spring clips of a known type, each of which has two loops 15, 16 engaging a particular round 14 and a single loop 17 engaging the next preceding round.

The guide 13 is arcuate about an axis which is displaced from the axis 12 and has a radius which is not less than the minimum bend radius of the linked ammunition in the plane of its individual rounds. A plurality of standard ammunition transport boxes 18 are secured to the underside of the guide 13 by means which are normally used to secure the lids of those boxes.

These means comprise a split hinge 19 having a leaf 20 secured to the underside of the guide 13 and a toggle catch 21 such as is provided on the lids of the boxes 18, also secured to the underside of the guide 13. As shown more clearly in FIG. 3 the leaf 20 and catch 21 are mounted so that the top of box 18 is spaced 20 mm below the bottom of the guide 13.

The boxes 18 are of the type having the British Ministry of Defence reference H83, Mark 2 being suitable for 0.50 inch Browing belt-linked ammunition, and have the general form of rectangular right prisms. The boxes 18 are spaced around the guide 13 sufficiently to provide clearance which enables each box 18 to pivot about its hinge 19 without fouling an adjacent box, but not by an amount which will enable its toggle 21 to be released. The boxes 18 must therefore be mounted sequentially on the guide 13 from an end thereof which is the closer to the breech 22 of the gun. Between that end of the guide 13 and the breech 22 is a flexible chute 23 of a type commercially available from Nobles Industries Inc., St. Paul, Minn.

Figure 2:
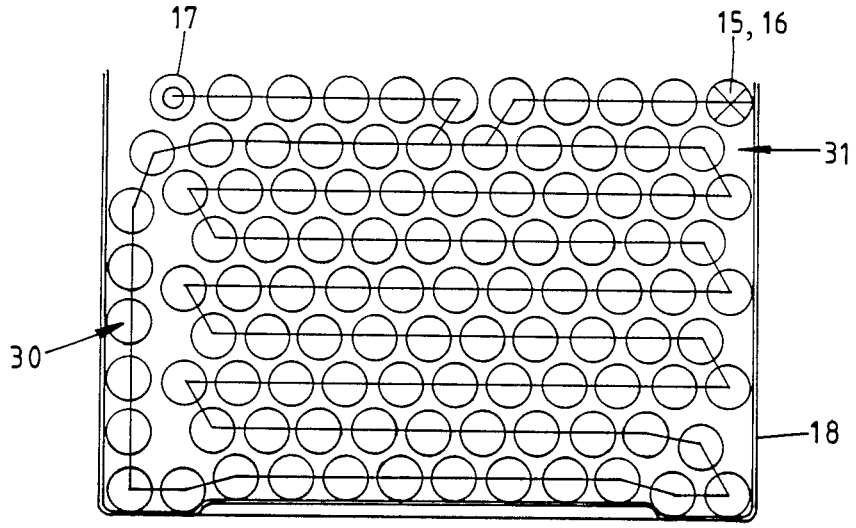
FIG. 2 is a diagram of a manner of packing an ammunition belt in a standard container.

The ammunition is packed in each of the boxes 18 in a manner shown in FIG. 2, such that both ends of the belt are accessible when the lid (not shown) is removed. Generally, this manner of packing comprises leading a vertical run 30 of the belt down one end of the box and across the bottom thereof, fan-folding seven additional layers of the belt and folding back the seventh additional layer 31 upon itself. The free end of the vertical run 30 also forms part of the seventh additional layer and is also folded back upon itself. The folded-back portion of the layer 31 terminates in a double loop 15, 16 (FIG. 4) from the preceding round of ammunition, the terminal double loop also containing a round of ammunition. The folded-back portion of the vertical run 30 terminates in a single loop 17 from the clip of the preceding round, the loop 17 being left empty.

Figure 3:
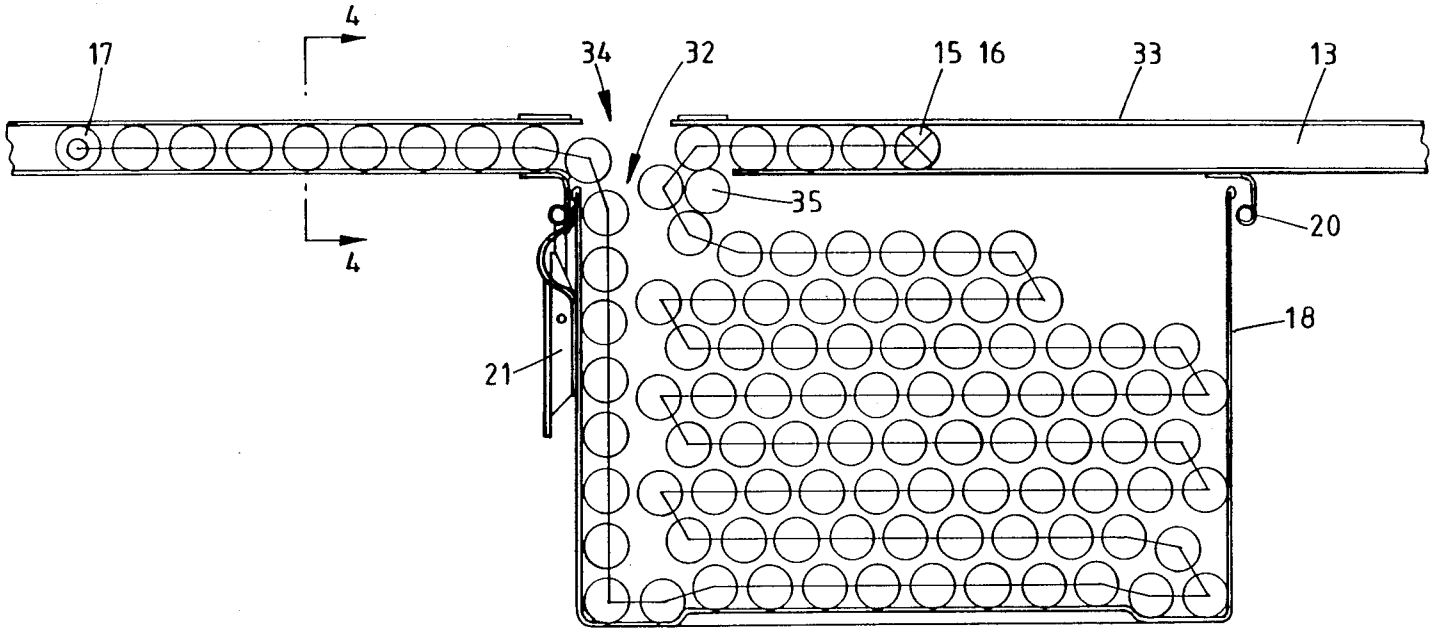
FIG. 3 is a diagram, corresponding to FIG. 2, of the ends of the belt linked to ends of adjacent belts.

As shown in FIG. 3 the underside of the guide 13 adjacent each toggle 21 is provided with an opening 32 through which the free ends of the belt can pass. Over the openings 32 the upper faces 33 of the guide 13 are cut away as shown at 34 in FIG. 1 so that the free ends of the belt may be lifted through for interconnection. This interconnection is effected by means of the round from the clip portions 15, 16 at one end of a belt section in a box 18, this round being first removed and reinserted in the empty clip portion 17 from a preceding box. It will be apparent that the leading round of the box adjacent the chute 23 is led through that chute to the breech 22.

A roller 35 is mounted on the underside of the guide 13 adjacent each opening 32 so that the rounds from each box may be freely pulled into the chute when required. The trailing edge of each opening 32 is provided with a small radius to prevent the belt clips catching thereon. The boxes 18 are prevented from moving sideways and thereby releasing the hinges 19 by brackets 36 (FIG. 1) which engage the sides of the boxes.

It will be seen from FIG. 1 that leading both ends of an ammunition belt from the same end of each box 18 enables the boxes 18 to occupy a substantial part of the arcuate guide 13 between adjacent openings 32. The boxes 18 need therefore to be spaced apart by no more than is necessary to allow them to pivot down about the hinges 19 for the free ends of the belts to be taken through the openings 32. The mean radius of the guide 13 need not therefore be greater than the aforesaid minimum effective bend radius of the ammunition. The openings 32 necessarily extend radially of the guide 13 in order to admit passage of the ammunition. The boxes 18 are mounted so that their end faces which are parallel to the axes of the rounds of ammunition therein, are also as shown parallel to and closely adjacent respective openings 32. The ammunition in each box 18 is thus aligned with the openings 32 and the longer sides of the boxes 18 thus extend tangentially of the inner and outer peripheries of the guide 13. This has the effect that the boxes 18 may pivot downwardly through 20° about their hinges 19, to assist in mounting or removal, without abutting an adjacent box 18, even though the boxes 18 are, in their mounted positions, spaced by about 34 mm only.

For some conditions of service it may be necessary to provide that the boxes 18 are mounted on the guide 13 by a support which is additional to, or substituted for, the hinges 19 and toggle catches 21 described above. Such a support may comprise a tray which engages the underside of a box 18 and is pivotally mounted about an axis adjacent and parallel to the radially inner, lower, longer edge of the box. The radially outer edge of the tray has straps pivotted thereon, these straps being engageable by toggles which are located in the general plane of the outer edge of the bracket 36 shown in FIG. 1.

In an alternative construction of the guide 13 arcuate rods, supported on brackets between the vertical sides of the guide 13, are substituted for the upper faces 33 of the guide 13.

We claim:

1. An apparatus for supplying belt-linked ammunition to a traversable gun, comprising a support which is formed as a circular arc about an axis of curvature, said support being coupled to the gun for traversing movement therewith, means for mounting a plurality of ammunition boxes at distance intervals along said support, said boxes containing ammunition belts which are so disposed as to render both free ends of the belt accessible from an open upper side of the box, said support including guide means for directing said free ends respectively towards said gun and towards an adjacent box, said guide means having openings with side walls through which said free ends can pass from said boxes to said guide means, said side walls of said openings being substantially aligned with respective radii extending from said axis of curvature, means for rigidly securing said boxes to said support so that a longer axis extending from a nose to a base of each round of ammunition is substantially parallel to the side walls of a respective one of said openings, said boxes being substantially rectangular right prisms.

2. An apparatus as claimed in claim 1 in which the radius of curvature of said arc in which said support is formed is not less than a minimum effective bend radius of the belt about an axis normal to the longer axes of the individual rounds of ammunition.

3. An apparatus as claimed in claim 1 or claim 2 which includes a flexible chute extending between an end of said support and a breech of the gun.

4. A method for supplying belt-linked ammunition to traversable gun, comprising packing a plurality of boxes with respective lengths of belt-linked ammunition so that the free ends of each said ammunition belt are accessible from an open upper side of a box of said plurality of boxes in which said ammunition is packed, said boxes being substantially rectangular right prisms, mounting said boxes at distance intervals along a support which is formed as a circular arc about an axis of curvature and which traverses with said gun, leading both of said free ends of each said ammunition belt through guides in said support by way of respective ones of a plurality of oenings in said support, said oepnings having side walls which are substantially aligned with respective radii extending from said axis of curvature, coupling one free end of one of the belts to a free end of a belt in an adjacent box, and coupling an opposite free end of said one belt to a breech of the gun, said boxes being secured to said supports so that a longer axis extending from a nose to a base of each round of ammunition in a box is substantially parallel to the side walls of the one of said openings through which that round is to pass.

* * * * *